United States Patent [19]

Dvorachek et al.

[11] 4,401,357

[45] Aug. 30, 1983

[54] ELECTRICAL CONNECTORS HAVING INSERT SPRING, CABLE CLIP AND CONTACTS WITH PRESSURE STRIPS

[75] Inventors: Harold A. Dvorachek, Iola, Kans.; Boleslaw M. Klimek, Des Plaines, Ill.

[73] Assignee: Echlin Inc., Branford, Conn.

[21] Appl. No.: 149,196

[22] Filed: May 12, 1980

[51] Int. Cl.[3] ..... H01R 11/10

[52] U.S. Cl. ..... 339/272 R

[58] Field of Search ..... 339/272 R, 272 A, 272 UC

[56] References Cited

U.S. PATENT DOCUMENTS

| | | | |
|---|---|---|---|
| 2,015,177 | 9/1935 | Frank | 339/272 UC |
| 2,585,055 | 2/1952 | Thomas et al. | 339/272 |
| 2,907,978 | 10/1959 | Bergan | 339/272 |
| 2,967,290 | 1/1961 | Zeller | 339/272 R |
| 3,178,671 | 4/1965 | Mastis | 339/272 R |
| 3,795,891 | 3/1974 | Bailey | 339/232 |
| 3,922,058 | 11/1975 | Kinnear | 339/272 R |

FOREIGN PATENT DOCUMENTS

| | | | |
|---|---|---|---|
| 1143556 | 2/1963 | Fed. Rep. of Germany | 339/272 UC |
| 1227969 | 11/1966 | Fed. Rep. of Germany | 339/272 UC |
| 2500141 | 7/1975 | Fed. Rep. of Germany | 339/272 A |

*Primary Examiner*—Joseph H. McGlynn

*Attorney, Agent, or Firm*—Neuman, Williams, Anderson & Olson

[57] ABSTRACT

A connector assembly is disclosed which includes a plug having a body of insulating material which is replaceably but securely held in a housing by means of an insert spring. A clip is provided for securely holding the end of a cable to the housing and contacts are disclosed having pressure strips for engagement with the conductors of wires.

4 Claims, 17 Drawing Figures

ELECTRICAL CONNECTORS HAVING INSERT SPRING, CABLE CLIP AND CONTACTS WITH PRESSURE STRIPS

This invention relates to electrical connectors and more particularly to electrical connectors which are readily assembled and otherwise easily and economically manufactured while being rugged and reliable in operation. The connectors of the invention are particularly advantageous where the environmental conditions of operation are adverse and where reliable performance is essential for safety, as in connectors for tractor-trailer combinations, for example.

BACKGROUND OF THE INVENTION

Connector assemblies have heretofore been provided in which a plug is insertable into a receptacle which may be mounted in a wall. The plug and receptacle include bodies of insulating material carrying interengageable female and male contacts which are connected to the ends of the conductors of wires disposed within the sheaths of suitable cables. Such connector assemblies have been generally satisfactory in operation but there have been problems which have not been recognized and dealt with by designers of such connectors.

For example, there have frequently been failures due to open circuits which can be very serious when the connector is used in critical applications. One cause of such open circuits which has not been recognized and dealt with is that the end of a conductor of a connecting wire may separate from the contact or become loosened in a manner such that the electrical connection between the contact and the wire may either be intermittent or completely ineffective.

Another problem relates to securing of the sheath portion of a cable to a housing. In prior arrangements, a screw has been provided having a terminal end portion engageable with the sheath portion of a cable and it is found that the screw can cut through the sheath portion in a manner such that there is inadequate frictional engagement with the sheath portion of the cable. In some cases, the screw may cut through the insulated portions of wires to cause electrical short-circuits or other problems of a similar nature.

Additional unrecognized problems with prior art connectors relate to the mounting of an insulating contact-carrying body within a protective housing, usually of metal. It is desirable to be able to securely lock the insulating body in the housing while permitting withdrawal therefrom in case it is necessary to do so for servicing. Also, it is desirable to be able to both insert and withdraw the body easily and quickly without going to an expensive constuction and without interfering with the reliability of the connector. The prior art arrangements while being generally satisfactory, have had deficiencies in such respects.

SUMMARY OF THE INVENTION

This invention was evolved with the general object of overcoming disadvantages of prior electrical connectors and of providing electrical connectors which are readily assembled and which are highly reliable in operation. It is also an object of the invention to provide connectors which are economically manufacturable while being highly satisfactory and reliable in performance.

An important aspect of the invention is in the recognition of the problem of open circuits between the end portion of the conductor of a connecting wire and the contact and in the recognition of the specific causes of that problem. In particular, it is found that with contacts in which the conductor end portion is positioned in an opening for engagement by the end of a fastener element such as a screw, the end portion of the screw may make engagement with only a very limited part of the conductor end portion and the conductor end portion may become dislodged from effective engagement by the end portion of the screw. The problem is particularly serious when the conductor is stranded in which case the screw may in effect cut through the conductor, separating the strands thereof and, as it is tightened, travel on through the conductor to the opposite side of the opening. In this case, there is no positive engagement with the conductor and it may be completely dislodged from the contact in some circumstances, especially when an axial separating force is applied.

In accordance with this invention, the conductor end portion is positioned in a trough and a pressure strip is positioned between the end of a screw or other fastening element and the bottom of the trough for engagement with an elongated portion of the conductor and for distribution of the pressure therealong. The pressure strip, which is preferably of sheet metal, may preferably have a width which is comparable to the width of the trough and it operates as a load distribution element to obtain distribution of pressure through a large area.

When the conductor is a solid conductor, the pressure strip operates to prevent the conductor from moving outwardly between the strip and the side walls of the trough, the width of the strip being large enough to provide spacings between it and the side walls which are less than the diameter of the minimum size conductor with which the contact is used. At the same time, the width of the strip is small enough to allow it to engage and compress the minimum size of conductor with which the contact is to be used. Thus, proper engagement with a solid type of conductor is insured.

The arrangement is also usable with stranded conductors and is especially advantageous in connection therewith in that the arrangement obviates the possibility of cutting through a standed conductor as is the case when a screw or other fastening element is used alone.

In accordance with specific features of the invention, the pressure strip as well as the trough and the support for the fastener element are all formed from a blank of sheet metal.

In accordance with another feature of the invention, a comparatively simple arrangement is provided for locking a contact-carrying body within a housing in a manner such that it is securely retained while also being removable if desired for servicing of the contacts or for any other reason. In accordance with this feature, an insert spring is provided which is of resilient metal and which includes a mounting portion anchored on the body and a lock portion which is resiliently urged radially outwardly. During insertion of the body, the lock portion is in pressure engagement with an inner surface of a peripheral wall of the housing and when the body reaches a certain operative position, the lock portion moves outwardly into a recess in the peripheral wall to be engageable with a rearwardly facing stop surface defined by the recess so as to prevent forward movement of the body relative to the housing.

In accordance with a specific feature, the insert spring is of sheet metal and includes inner and outer leg portions which extend forwardly from a rearward U-shaped portion, the mounting and lock portions being formed at the forward ends of such leg portions. Preferably, the mounting and lock portions include outwardly offset portions and the body may preferably include recesses which receive an inwardly projecting portion at the forward end of the mounting portion and the rearward portion of the inner leg. With this construction, the insert spring is readily installed and it functions reliably in moving the lock portion into the recess of the housing wall. At the same time, it can be readily and economically manufactured.

Additional features of the invention relate to an arrangement for securing a connector to a cable. In accordance with the invention, a cable including an outer sheath portion and wires therewithin is inserted in an opening of a housing to position an end portion of the sheath portion of the cable therewithin and a metal clip is disposed on the inside of the opening with a portion thereof extending in an axial direction on the outside of the sheath portion for engagement therewith. Then a screw is threaded through the housing member and engages the outside of the metal clip to press the aforesaid portion thereof into tight frictional engagement with the sheath portion of the cable. Preferably, the clip includes radially outwardly extending forward and rearward end portions for engagement with surfaces of the housing member to limit forward and rearward movement, and, most preferably, each of such end portions has an in-turned end for embracing a lip portion of the housing member. With these features, the cable is securely locked to the connector housing and the clip functions to prevent damage to the cable. It is particularly important in that it prevents the screw from piercing the sheath, entering between and stripping the insulation of wires to cause electrical short circuits.

This invention contemplates other objects, features and advantages which will become more fully apparent from the following detailed description taken in conjunction with the accompanying drawings.

DESCRIPTION OF A PREFERRED EMBODIMENT

Figures 1, 2, 3, 4, 5, 6, 7, 8, 9, 10, 11:
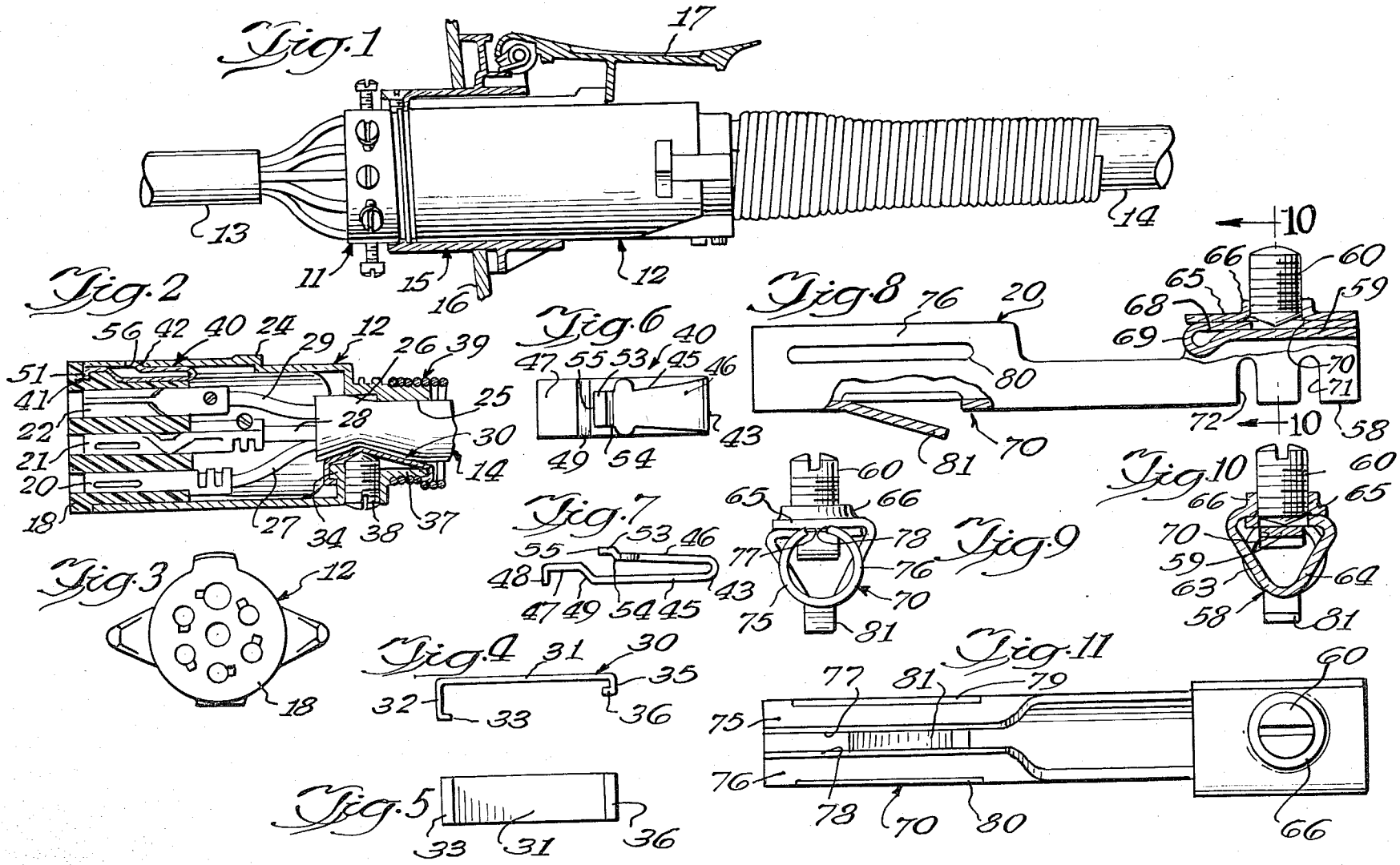
FIG. 1 is a side elevational view, partly in section, illustrating a connector assembly constructed in accordance with the principles of the invention.
FIG. 2 is a cross-sectional view through a plug of the assembly of FIG. 1.
FIG. 3 is an end elevational view of the plug of FIG. 2.
FIG. 4 is a side elevational view on an enlarged scale of a metal clip of the plug of FIG. 2.
FIG. 5 is a bottom plan view of the metal clip of FIG. 4.
FIG. 6 is a top plan view on an enlarged scale of an insert spring used in the plug of FIG. 2.
FIG. 7 is a side elevational view of the clip of FIG. 6.
FIG. 8 is a side elevational view, partly in section, illustrating a female contact used in the plug of FIG. 2.
FIG. 9 is a front elevational view of the contact shown in FIG. 8.
FIG. 10 is a sectional view taken substantially along line X—X of FIG. 8.
FIG. 11 is a top plan view of the contact of FIG. 8.

Reference numeral 10 generally designates a connector assembly constructed in accordance with the principles of the invention. The connector assembly 10 may be used, for example, in making connections between electrical components in tractor-trailer combinations, it being understood that the invention is not limited to any particular type of use.

The assembly 10 includes a receptacle body 11 which carries male contacts engageable with female contacts which are carried by a plug 12, the contacts being connected to conductors of wires in cables 13 and 14. The receptacle body 11 is mounted in a housing 15 which is preferably of metal and which may be mounted on a metal wall 16, a hinged cover 17 being provided which is spring urged to close the forward end of the housing when the plug 12 is withdrawn.

FIG. 2 is a cross-sectional view through the plug 12 which includes a body 18 of insulating material carrying a plurality of contacts. Three contacts 20, 21 and 22 are shown in the cross-sectional view of FIG. 2 and a total of seven contacts may be provided as shown in the end view of FIG. 3. The body 18 is mounted within a forward end of a housing 24 which may preferably be of metal and which includes a rearward opening 25 which receives a sheath portion 26 of the cable 14. FIG. 2 shows three wires 27, 28 and 29 extending from the cable 14 and having conductors secured to the contacts 20, 21 and 22. Additional wires, not shown are connected to the other contacts.

To secure the cable 14 to the housing 24, a metal clip 30 is provided on the inside of the opening 25, having a portion 31 extending in an axial direction along the outside of the sheath portion 26 for engagement therewith. A forward end portion 32 of the clip 30 extends radially outwardly to an in-turned terminal end 33 which engages a lip 34 formed at the inner end of the opening 25. The clip 30 additionally has a rearward end portion 35 extending radially outwardly to an in-turned terminal end 36 which engages the end of a rearwardly extending sleeve portion 37 of the housing 24. The portion 31 of the clip 30 is engaged by the terminal end of a screw 38 which is threaded through a wall of the housing 24 and the clip 30 functions to provide distributed pressure engagement with the sheath 26 to securely hold the sheath against axial movement while preventing localized forces which might cut through or rupture the sheath 14 and damage the wires therewithin.

The sleeve portion 37 of the housing 24 preferably is externally threaded for receiving the forward end of a coiled spring 39 which surrounds and protects the cable 14 against unduly sharp bending.

To secure the body 18 in the housing 24, an insert spring 40 is provided which includes a mounting portion 41 anchored to the body 18 and a lock portion engageable in a recess 42 of the wall of the housing 24. The spring 40 preferably is of sheet metal and includes a rearward U-shaped portion 43 and forwardly extending inner and outer leg portions 45 and 46, the mounting portion 41 being formed at the forward end of the inner leg portion 45 and the lock portion being formed at the end of the outer leg portion 46. As illustrated, the mounting portion 41 includes an offset portion 47 which is outwardly offset relatively to the inner leg portion 45, with a terminal end portion 48 extending radially inwardly from the rearward end of the offset portion 47 and with a connecting portion 49 between the forward end of the offset portion 47 and the rearward end of the inner leg portion 45. The terminal end portion 48 engages in a recess 51 in the body portion 18.

The lock portion of clip 40 includes an outwardly offset portion 53 and a connecting portion 54 between the rearward end of the offset portion 53 and the forward end of the outer end portion 46. A surface 55 at the forward terminal end of the offset portion 53 engages a surface 56 in the recess 42 of the wall of the housing 24.

In operation, the insert spring 40 is disposed on the outside of the body 18 which is then inserted rearwardly into the housing 24. During insertion, the portion 53 engages the inner surface of the wall of the housing 24, the spring 40 being deformed during the insertion operation. When the body member reaches the position as shown in FIG. 2, the portion 53 is moved radially outwardly by the resiliency of the spring 40 to engage in the recess 42 the surface 55 at the terminal end of the offset portion 53 being then engageable with the surface 56 of the recess 42 to prevent forward movement of the body portion 18 relative to the housing 24.

If it is desired to remove the body 18 for servicing of the contacts or for any other reason, the user may engage the offset portion 53 and move it radially inwardly until the surface 55 clears the surface 56 and the body 18 may then be withdrawn. It is noted that at the same time, the screw 37 may be loosened to allow the cable 14 to be moved forwardly through the opening 25.

Important features of the invention relate to the construction of the contacts and more particularly to a construction which provides very secure attachment of the conductor of a wire to the contact. The construction of the contact 20 is illustrated in FIGS. 8–11, it being understood that the other contacts may have a similar construction. In a preferred arrangement, the contact 20 which is a grounding contact in the illustrated assembly, is larger than the other contacts but the basic construction of all contacts may be the same.

The contact 20 includes a trough portion 58 which is arranged to receive the end portion of a conductor of the wire 27. A pressure strip 59 overlies the conductor end portion and is arranged to be operated by a fastener in the form of a screw 60 to be moved toward a bottom wall portion 61 of the trough portion 58, between side wall portions 63 and 64 thereof. The screw 60 is supported from the trough portion 58, preferably including a portion 65 which extends from the upper end of the side wall portion 63 toward the upper end of the side wall portion 64, a collar portion 66 being preferably provided on the portion 65 for receiving the screw 60.

The pressure strip 59 preferably has a width small enough to engage and compress the smallest size of conductor with which the contact is usable before engaging the side wall portions 63 and 64 and large enough to provide openings between it and the side wall portions 63 and 64 which are smaller than the diameter of the smallest size of conductor with which the contact is usable. When strip 59 is moved toward the bottom 61 of the trough portion 58, it serves to distribute the pressure applied to the conductor over a wide area and along the length of the conductor, to obtain a maximum amount of frictional force opposing withdrawal of the conductor. It is particularly advantageous when the conductor is a stranded conductor in that it prevents the fastener from cutting through the conductor and moving into engagement with the bottom of the trough. It is also advantageous in connection with solid conductors in that it prevents a solid conductor from becoming displaced to one side in a manner such as to allow withdrawal thereof.

To support the pressure strip 59, a support section 68 is provided which extends from the upper end of the side wall 64 toward the upper end of the side wall 63 with one end of the pressure strip 59 being connected to one end of the support section 68, preferably through a 180 degree bend 69. The support section 68 has an opening 70 through which the screw 60 extends to engage the pressure strip 59.

For increased holding engagement with a conductor end portion, the bottom wall portion 61 of the trough portion 58 may be formed with transverse slots 71 and 72.

It is noted that with the construction as illustrated and described, the contact may be formed from a single blank of sheet metal. In forming the contact, the pressure strip 59 may be initially bent back against the support section 68, forming the 180 degree bend 69 and side walls 63 and 64 may be turned toward each other to form the trough section 58. After performing such steps, the support section 69 may be bent inwardly after which the section 65 is bent inwardly over the support section 68 to the position as illustrated.

The contact 20 is a female contact and includes a contact portion 74 formed by a pair of side wall portions 75 and 76 which extend arcuately from a bottom line to upper terminal edges 77 and 78 spaced a short distance apart. The radius of the inner surfaces of the side wall portions 75 and 76 is less than that of a mating male contact (hereinafter described) and when the male contact is inserted, the side wall portions 75 and 76 are selectively flexed outwardly to tightly engage the male contact. To increase the resiliency of the side wall portions 75 and 76, longitudinally extending slots 79 and 80 may be provided therein.

To lock the contact 20 in the body 18, the contact portion 74 includes a tab 81 struck out of the bottom thereof and extending angularly downwardly and rearwardly. When the contact 20 is inserted into the body 18, the tab 80 is resiliently deflected upwardly until an operative position is reached at which the tab 81 springs back downwardly whereupon its terminal end is engageable with a stop surface of the body to prevent withdrawal of the contact 20.

Figures 12, 13, 14, 15, 16, 17:
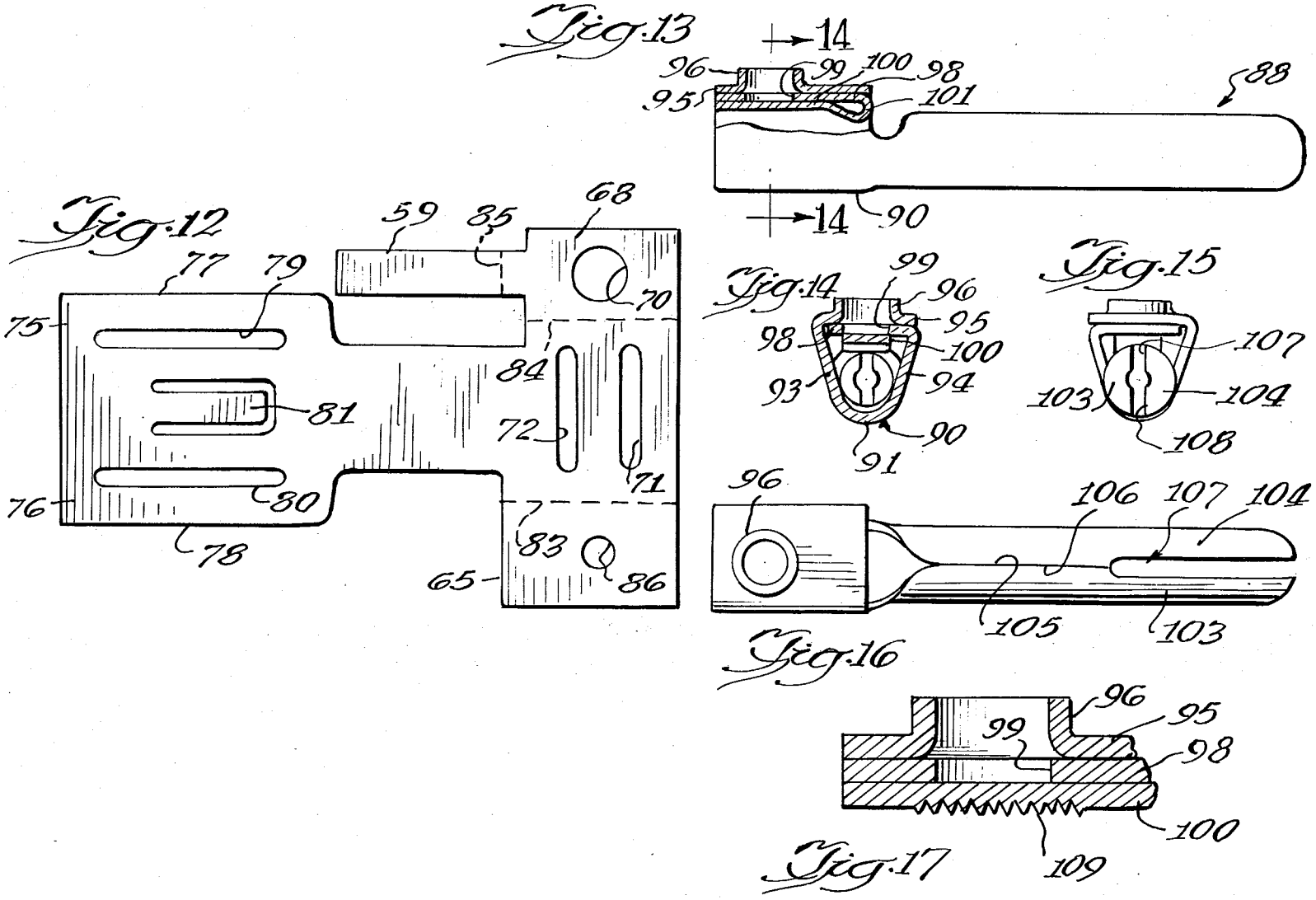
FIG. 12 is a plan view of a blank used in forming the contact of FIG. 6.
FIG. 13 is a side elevational view, partly in section, illustrating a male contact usable in a receptacle of the connector assembly of FIG. 1.
FIG. 14 is a sectional view taken substantially along line XIV—XIV of FIG. 13.
FIG. 15 is a front elevational view of the contact of FIG. 13.
FIG. 16 is a top plan view of the contact of FIG. 13.
FIG. 17 is a sectional view of a pressure strip of the contact of FIG. 13, illustrating serrations thereof.

FIG. 12 shows the configuration of a blank for formation of the contact 20 and it will be noted that the approximate location of the centers of the bends for forming the junctions between side wall portions 63 and 64 and the portions 65 and 68 are indicated by broken lines 83 and 84. The approximate location of the center of the 180 degree bend between the pressure strip 59 and the support portion or section 68 is indicated by broken line 85. An opening 86 is provided in the portion 65 which initially is of a relatively small diameter as indicated, being enlarged to form the collar 66 for receiving the screw 60. It is further noted that the strip 59 might extend rearwardly from the rearward edge of the support section or portion 68, rather than forwardly from the forward edge as illustrated. The arrangement as illustrated has the advantage that less material is required for formation of the contact.

The collar 66 might be formed with internal threads for receiving the screw 60 which might have a standard machine screw thread but preferably, the screw 60 is formed with self-cutting threads which has the advantage of economy and also it can operate to more securely lock the sections 65 and 68 together when it is threaded therethrough.

FIGS. 13, 14, 15 and 16 illustrate a male contact generally designated by reference numeral 88 and designed to be mounted in the receptacle body 11 to cooperate with the female contact 20 when the plug 12 is inserted into the housing 15. The contact 88 has a rearward portion for receiving the end portion of a conductor of a wire, such being constructed in a manner quite similar to the manner of construction of the rearward portion of the contact 20. It includes a trough portion 90 corresponding to the trough portion 58 and including a bottom wall 91 and side walls 93 and 94. It further includes a portion 95 extending inwardly from the upper edge of the side wall portion 93 and formed with a collar 96 for receiving a screw, not shown. In addition, a support section 98 is provided which extends inwardly from the upper edge of the side wall portion 94 and which has an opening 99 aligned with the collar 96. A pressure strip 100 is supported from the support section 98 through a 180 degree bend 101. The forward end of the contact 88 is formed to provide a generally cylindrical contact portion having a forward rounded end. The forward portion is formed from two side wall portions 103 and 104 having upper edge portions 105 and 106 which meet at the rearward part thereof, the forward ends of the upper edges being cut away to provide a top slot 107 and the bottom of the contact being cut away to provide a bottom slot 108. Slots 107 and 108 increase the resiliency of the contact and facilitate its insertion into the female contact.

As shown in FIG. 15, the strip 100 of the contact 88 is formed with a lower surface 109 which is serrated so as to provide increased frictional engagement with the conductor end portion. It is noted that the pressure strip 59 of the female contact 20 may be formed with similar serrations and also, the male contact 88 may be formed with slots 79 and 80 such as used in the female contact 20, if desired.

It will be understood that modifications and variations may be effected without departing from the spirit and scope of the novel concepts of the invention.

What is claimed is:

1. An electrical contact for connection to the end portion of a conductor of a wire, comprising: a trough portion arranged to receive said conductor end portion and including a pair of side walls and a bottom wall, a pressure strip extending longitudinally along said trough portion in upwardly spaced relation to said bottom wall for overlying the length of said conductor end portion and for movement toward said bottom wall to press said conductor end portion between said strip and said bottom wall, said strip having a width large enough to provide openings between it and said side walls which are smaller than the diameter of said conductor end portion, a fastener having a terminal end for engagement with a portion of said strip which is intermediate said one end thereof and an opposite end thereof for moving said strip toward said bottom wall, and a fastener support for supporting said fastener from said trough portion, said trough portion, pressure strip and fastener support being formed as integral parts of a single element of sheet metal, said element including a strip-support section extending from one of said side walls of said trough portion toward the other of said side walls of said trough portion and over said pressure strip with said pressure strip having an end connected through a 180 degree bend to one end of said strip-support section, said strip-support section having an opening therein through which said fastener element extends, and said fastener-support being in the form of a section of said element of sheet metal extending from the upper edge of said other of said side walls of said trough portion toward the upper edge of said one of said side walls of said trough portion in overlying relation to said strip-support section.

2. In a contact as defined in claim 1, said fastener being in the form of a screw and said fastener-support including a collar portion receiving said screw.

3. In a contact as defined in claim 1, said pressure strip having a serrated surface for engagement with said conductor end portion.

4. In a contact as defined in claim 1, a contact portion formed as an integral part of said element of said sheet metal and extending in a longitudinal direction from an end of said trough portion which is in transverse alignment with said 180 degree bend.

* * * * *